US006136432A

United States Patent [19]

Burrow et al.

[11] Patent Number: 6,136,432

[45] Date of Patent: Oct. 24, 2000

[54] SEWING THREAD, ARTICLES SEWN THEREWITH, AND DYEING OF SUCH ARTICLES

[75] Inventors: Thomas Richard Burrow, Coventry; Emmanuel Stephane Coulon; Robert John Morley, both of Rugby; Calvin Roger Woodings, Warwickshire, all of United Kingdom

[73] Assignee: Acordis Fibres (Holdings) Limited, Derby, United Kingdom

[21] Appl. No.: 09/402,745

[22] PCT Filed: Apr. 15, 1998

[86] PCT No.: PCT/GB98/01095

§ 371 Date: Oct. 12, 1999

§ 102(e) Date: Oct. 12, 1999

[87] PCT Pub. No.: WO98/46816

PCT Pub. Date: Oct. 22, 1998

[30] Foreign Application Priority Data

Apr. 16, 1997 [GB] United Kingdom ..... 9707694

[51] Int. Cl.[7] ..... D01F 6/00

[52] U.S. Cl. ..... 428/362; 428/393

[58] Field of Search ..... 428/362, 364, 428/393; 8/194, 441; 442/199, 200

[56] References Cited

U.S. PATENT DOCUMENTS 6,013,367 1/2000 Nakagawa et al. ..... 428/393
6,068,666 5/2000 Pimick et al. ..... 8/441

*Primary Examiner*—Newton Edwards
*Attorney, Agent, or Firm*—Howson & Howson

[57] ABSTRACT

A sewing thread consists of from 70 to 95 percent by weight of lyocell fibre and from 5 to 30 percent by weight of at least one synthetic fibre such as polyester or polyamide. The sewing thread can be used for sewing garments, particularly those comprising a major proportion of cellulosic fibres, and can be dyed with a dyestuff for cellulose.

10 Claims, No Drawings

SEWING THREAD, ARTICLES SEWN THEREWITH, AND DYEING OF SUCH ARTICLES

FIELD OF THE INVENTION

This invention relates to sewing threads and to articles sewn therewith, in particular articles which comprise a major proportion of cellulosic fibre, as well as to the dyeing of such articles.

BACKGROUND ART

Sewing threads are described for example by E Oxtoby in Spun Yarn Technology, Butterworth & Co. (1987), at pages 214–215. Sewing threads may be of continuous filament yarn or of staple fibre. For cellulosic articles, threads which comprise cotton (often mercerised cotton) are commonly used. It is often desirable that the sewing thread and the article to be sewn should be of the same or similar materials for compatibility of properties. Thus, if a sewn article is to be subsequently dyed, it is desirable that the article and the sewing thread should exhibit similar dyeing characteristics.

The tensile strength of cotton sewing threads is often not as high as could be desired. This is true even of mercerised cotton threads, which are of higher strength than unmercerised cotton threads. Accordingly, it is known to make sewing threads from a blend of cotton and a synthetic fibre such as polyester or polyamide which is stronger than cotton. Such threads generally comprise more than 30 percent by weight of the synthetic fibre, because it is known that the strength of such sewing thread which comprises less than about 30 percent by weight of the synthetic fibre may be unsatisfactorily low, even to the extent of being lower than that of a thread consisting solely of cotton. The inclusion of synthetic fibre also serves usefully to increase the abrasion resistance of the thread. Good abrasion resistance is a desirable feature in a sewing thread, because the sewn thread is often exposed at the surface of a sewn article, thus rendering it especially liable to abrasion. However, such blended sewing threads in general exhibit different dyeing characteristics from those of the bulk of a sewn article, for example a textile article such as a woven or knitted garment which comprises a major proportion of cellulosic fibre.

DISCLOSURE OF INVENTION

According to a first aspect of the invention, there is provided a sewing thread which consists of from 70 to 95 percent by weight of lyocell fibre and from 5 to 30 percent by weight of at least one synthetic fibre.

Lyocell is the generic name for a cellulosic fibre manufactured by dissolution of cellulose in an organic solvent without formation of a chemical derivative of cellulose, followed by extrusion through a spinnerette into a coagulating bath, washing and drying. The organic solvent may comprise a mixture of organic chemicals and water. The organic solvent may be an aqueous tertiary amine N-oxide, particularly aqueous N-methylmorpholine N-oxide.

The sewing thread of the invention is preferably a spun yarn of staple fibres. The synthetic fibre is preferably polyester, for example poly(ethylene terephthalate), or polyamide, for example nylon[6:6] or nylon[6]. Mixtures of different synthetic fibres can be used. The sewing thread of the invention may be made by spinning, doubling and suchlike known processes and may be of any convenient known construction. The sewing thread of the invention may be treated with sizes or lubricants of known type and in known manner.

A preferred sewing thread according to the invention consists of from 75 to 90 percent by weight of lyocell fibre and from 10 to 25 percent by weight of the at least one synthetic fibre.

It has been found that the tensile strengths of lyocell yarns and of polyester yarns are similar and that the tensile strengths of lyocell/polyester blended yarns are intermediate between those of the yarns of the individual fibres. Such blended yarns therefore differ from cotton/polyester blended yarns, whose tensile strengths may be lower than that of a 100% cotton yarn.

The inclusion of synthetic fibre in the sewing thread of the invention confers improved abrasion resistance on the thread. For example, the abrasion resistance of an 80/20 lyocell/polyester thread may be twice that of a 100% lyocell thread. The higher abrasion resistance of lyocell/polyester blended fabrics in comparison with lyocell fabrics is known per se.

When known types of blended sewing thread which contain both cotton fibre and synthetic fibre are dyed, it may be necessary to subject them to two dyeing processes, one to dye the cellulosic (including cotton) fibre and the other to dye the synthetic fibre. In contrast, sewing thread according to the invention in general requires only a single dyeing process with a dyestuff for cellulose, thereby dyeing the cellulosic fibre only. The proportion of synthetic fibre in the sewing thread of the invention is sufficiently low that in many cases the presence of undyed synthetic fibre in the dyed thread has little or no appreciable effect on its visual appearance, notably in an article sewn with the dyed thread.

Mercerised cotton and synthetic fibres such as polyester exhibit high lustre, in comparison for example with unmercerised cotton. On occasion, high lustre may be undesirable in a sewing thread, because of the resulting visual contrast between the thread and the body of an article sewn therewith. Advantageously, the lustre of the sewing thread of the invention is similar to that of the lyocell component alone and is accordingly similar to that of articles of cellulosic fibres such as cotton and lyocell.

According to a second aspect of the invention, there is provided a sewn article wherein the sewing thread is according to the first aspect of the invention. The sewn article may be a textile article, for example a woven or knitted garment. The sewn article preferably comprises a major proportion of cellulosic fibres, which may be natural fibres such as cotton or manmade fibres such as viscose rayon or lyocell.

Advantageously, articles comprising a major proportion of, or consisting of, cellulosic fibres sewn with the sewing thread of the invention can be dyed without generating obtrusive colour differences between the thread and the bulk of the article.

According to a third aspect of the invention, there is provided a method for the manufacture of a sewn and dyed article which comprises a major proportion of cellulosic fibres, comprising the steps of:

(i) sewing the article with a sewing thread according to the first aspect of the invention; and (ii) dyeing the sewn article with a dyestuff for Preferably, the sewn article is dyed only with a dyestuff for cellulose.

EXAMPLE

An 80:20 blend of lyocell and polyester staple fibre can be ring-spun on the cotton system to yield a 20 tex yarn, which can be doubled to yield a 40 tex sewing thread.

What is claimed is:

1. A sewing thread which consists of from 70 to 95 percent by weight of lyocell fibre and from 5 to 30 percent by weight of at least one synthetic fibre.

2. A sewing thread according to claim 1, which consists of from 75 to 90 percent by weight of lyocell fibre and from 10 to 25 percent by weight of the at least one synthetic fibre.

3. A sewing thread according to claim 1, wherein the synthetic fibre is polyester fibre or polyamide fibre.

4. A sewing thread according to claim 1, which is a spun yarn of staple fibres.

5. A sewing thread according to claim 1, which has been dyed with a dyestuff for cellulose only.

6. A sewn article sewn with a sewing thread which consists of from 70 to 95 percent by weight of lyocell fibre and from 5 to 30 percent by weight of at least one synthetic fibre.

7. A sewn article according to claim 6, which is a woven or knitted garment.

8. A sewn article according to claim 6, which comprises a major proportion of cellulosic fibres.

9. A sewn article according to claim 8, which consists of cellulosic fibres.

10. A method for the manufacture of a sewn and dyed article, comprising the steps of:

(I) forming a sewn article consisting wholly or to a major extent of cellulosic fibres sewn with a sewing thread which consists of from 70 to 95 percent by weight of lyocell fibre and from 5 to 30 percent by weight of at least one synthetic fibre; and (ii) dyeing the sewn article with a dyestuff for cellulose.

* * * * *

UNITED STATES PATENT AND TRADEMARK OFFICE

CERTIFICATE OF CORRECTION

PATENT NO. : 6,136,432 
DATED : October 24, 2000
INVENTOR(S) : Thomas R. Burrow, Emmanuel S. Coulon, Robert J. Morley, and Calvin R. Woodings It is certified that error appears in the above-identified patent and that said Letters Patent is hereby corrected as shown below:

Title page,
After "6,068,666 5/2000 Pimick et al.....8/441" insert the following:

-- FOREIGN PATENT DOCUMENTS
WO 95/24524 9/95 PCT
DE 38 44 615 3/90 Germany
DE 44 41 743 5/96 Germany

OTHER PUBLICATIONS

Patent Abstracts of Japan (Abstract), Publication No. 02277841, 1990 --

Signed and Sealed this

Twenty-eighth Day of August, 2001

*Attest:*

Nicholas P. Godici

*Attesting Officer*

NICHOLAS P. GODICI
*Acting Director of the United States Patent and Trademark Office*